US006446607B1

(12) United States Patent
Hlousek

(10) Patent No.: US 6,446,607 B1
(45) Date of Patent: Sep. 10, 2002

(54) CONTROL ELEMENT FOR CONTROLLING INJECTION SYSTEMS

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/869,959

(22) PCT Filed: Nov. 8, 2000

(86) PCT No.: PCT/DE00/03900

§ 371 (c)(1),
(2), (4) Date: Dec. 6, 2001

(87) PCT Pub. No.: WO01/34966

PCT Pub. Date: May 17, 2001

(30) Foreign Application Priority Data

Nov. 10, 1999 (DE) ..... 199 54 057

(51) Int. Cl.[7] ..... F02M 37/04
(52) U.S. Cl. ..... 123/458
(58) Field of Search ..... 123/446–7, 458, 123/467, 447

(56) References Cited

U.S. PATENT DOCUMENTS 4,530,329 A * 7/1985 Maisch et al. ..... 123/447
5,125,807 A * 6/1992 Kohler et al. ..... 417/490
5,275,207 A * 1/1994 Tonhauser et al. ..... 137/870

FOREIGN PATENT DOCUMENTS

DE 197 38 397 * 3/1999 ..... F02M/43/00
EP 0 879 979 * 11/1998 ..... F16K/11/07

* cited by examiner

*Primary Examiner*—Thomas N. Moulis
(74) *Attorney, Agent, or Firm*—Ronald E. Greigg

(57) ABSTRACT

A control element for an injection system, which includes a high-pressure collection container, from which a high-pressure line extends to a housing surrounding the control element. The housing includes both a pressureless outlet to a reservoir and a connecting bore leading to injection systems. The overlap of the inlet-side control edges, which causes the closure of the high-pressure line, is brought about by means of triggering actuating devices, reinforced by at least one force reservoir assigned to the control element.

10 Claims, 2 Drawing Sheets

CONTROL ELEMENT FOR CONTROLLING INJECTION SYSTEMS

CROSS-REFERENCE TO RELATED APPLICATIONS

This application is a 35 USC 371 application of PCT/DE 00/03900 filed on Nov. 8, 2000.

BACKGROUND OF THE INVENTION

1. Field of the Invention

Hydraulically driven injection pumps via injectors to be operated hydraulically execute a control event, which brings about the end of supply and the applicable onset of supply, by means of a movable control element. The control element is triggered within very short switching times, which can be less than 2 ms. The strokes that the control element executes are longer than 0.3 mm.

2. Prior Art

In injectors that communicate with a high-pressure collection chamber (common rail) that is common to a plurality of injectors, or in hydraulically driven injection pumps, very short switching and trigger times may be necessary for executing stroke motions of a control element. The requisite switching times can be less than 2 ms; in very small units acted upon hydraulically, that is, units with a very small flow cross section, direct magnet control can be employed where a 3/2-way control element can for instance be embodied, if stroke motions that are shorter than 0.3 mm in stroke length are to be executed by the control element. If longer control element strokes are needed, then direct magnet triggering of the control element, embodied as a control slide, runs up against its intrinsic limits.

Another variant is servo-triggering of the control slide, but it can be achieved only whenever the stroke lengths to be traversed by the control element to close the control edges do not exceed the aforementioned limits.

Once again, the same restriction applies, that the servo-triggering can be used preferably only in small units of small flow cross section, in which the adjusting forces are accordingly still within the order of magnitude that can be handled with servomotors. In use in large diesel engines, which require adjusting units with a relatively large flow cross section, conversely, both greater flow quantities and as a result greater adjusting forces occur, which cannot be controlled using servomotors alone or by triggering the control slide only magnetically.

SUMMARY OF THE INVENTION

With the embodiment of the invention, direct electronic regulation of a valve unit for relatively large flow cross sections is now feasible, which is also suited, among other applications, to large diesel engines. Because of the high pressures that then occur, high adjusting forces arise, which can be controlled with the proposed embodiment that is reinforced with a force reservoir. The longer adjusting paths with larger units can be traversed substantially faster with the embodiment according to the invention, and the incident closing forces can be furnished more quickly; the degree of overlap of the control edges between the control element and the surrounding housing can be selected such that effective sealing off of the high-pressure line from the pressureless outflow line is attainable.

The system reliability if the supply voltage fails is assured by the subjection of the inlet-side end of the control element to a force reservoir that reinforces the closing motion of the control element. The force reservoir—embodied for instance as a helical spring—associated with the inlet-side end is dimensioned such that in the event of a voltage failure at one of the actuating devices, closure of the high-pressure inlet line is always assured. To limit the opening and closing of the high-pressure line and the pressureless outlet, stops that limit the prestressing of the force reservoir are provided in the housing bore that surrounds the control element.

The control element of the invention—embodied as a control slide—can for instance communicate with an injection nozzle, in order to inject fuel, which is under extremely high pressure, into a combustion chamber, or can serve to supply a hydraulically operatable piston pump. With the embodiment of the control element as a force reservoir—reinforced control system, according to the invention, the briefest possible switching times can be achieved, yet the stroke paths are still lengthened. The short switching times at the control element are feasible because one force reservoir each, assigned to the end of the control element, reinforces the control element motion executed by the triggering of one of the actuating devices and thus shortens the switching time. Depending on the dimensioning of the spring, preferably embodied as helical springs—connected either in parallel or in series—the system reliability in the event of a current failure can be achieved by providing that in a current failure, the force reservoir that reinforces the closing of the high-pressure inlet line is dimensioned larger, in order to generate higher closing forces on the inlet-side end of the control element embodied as a control slide.

BRIEF DESCRIPTION OF THE DRAWINGS

The invention will be described in further detail below in conjunction with the drawings, in which.

DESCRIPTION OF THE PREFERRED EMBODIMENTS

Figure 1:
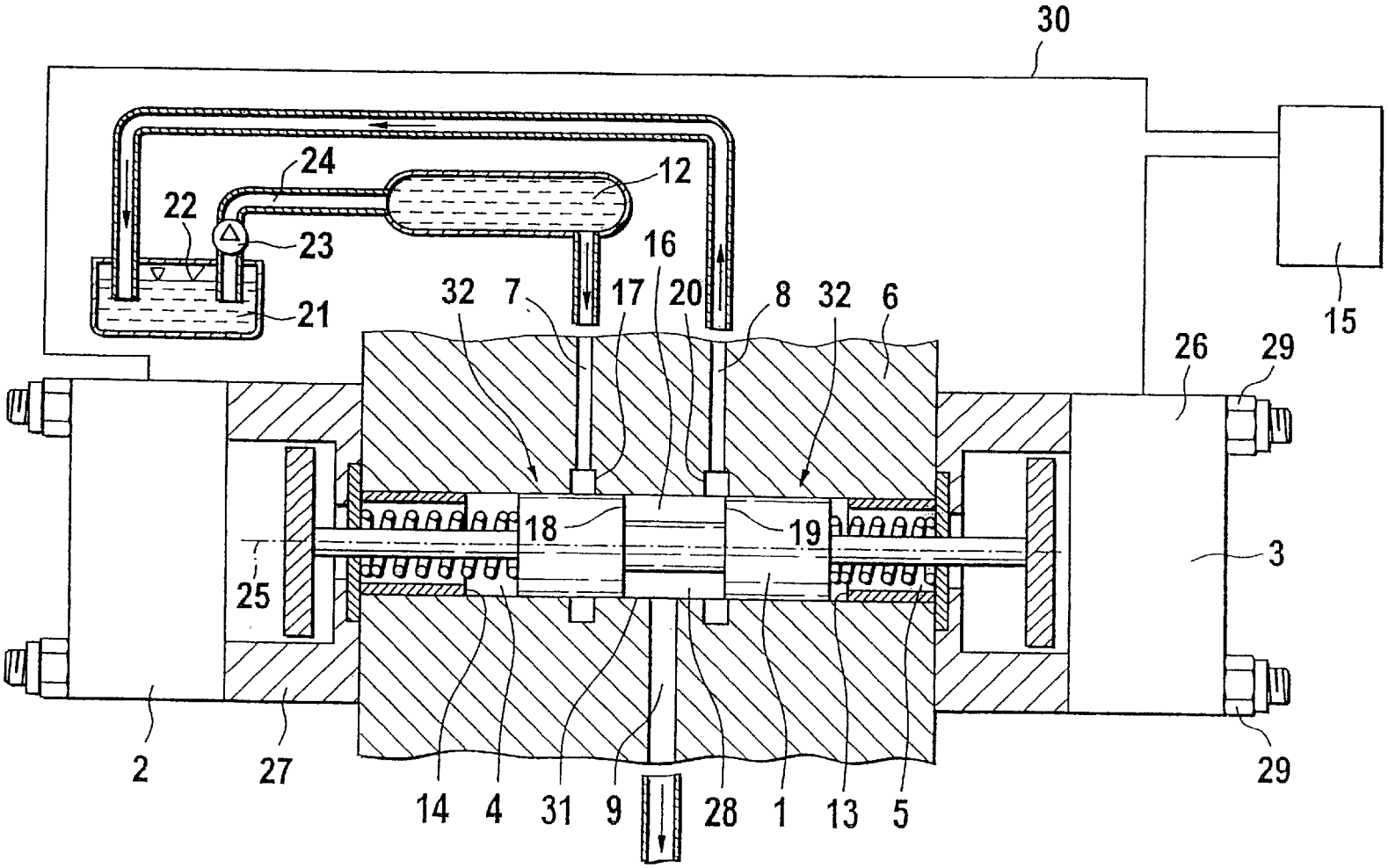
FIG. 1 is a sectional view schematically illustrating the structure of a 3/2-way valve unit, having electrically triggerable actuating devices assigned to the control element.

In the embodiment of FIG. 1, a 3/2-way valve is shown, with a control element which can be moved via two individually triggerable actuating devices.

A control element 1 embodied as a control slide is received in a housing 6 of a 3/2-way valve. Faces are provided on each of the ends of the control element 1, and these faces are disposed opposite the actuating devices 2, 3. The actuating devices 2, 3 are preferably embodied as electrically triggerable electromagnets, which can be triggered via a control unit 15 that triggers actuating devices 2, 3 separately from one another. The actuating devices 2, 3 embodied preferably as electromagnets are opposite faces of larger diameter, compared to the diameter of the control element.

The control element 1 embodied as a control slide is received in the bore 31 of the housing 6. The bore 31 around the control element 1 is embodied with the narrowest possible tolerances, to keep the leakage losses that occur in the relative motion of the components to one another as slight as possible. The control element 1, as a movable component, is preferably made from high-quality material, while the housing 6 of the 3/2-way valve can be made of less expensive material instead. Two cylindrical closing bodies 32 are provided on the control element 1, with their end faces toward one another spaced apart from another. The cylindrical closing bodies 32 on one side define a hollow chamber 28 inside the bore 31 of the housing 6 and on the other, the cylindrical closing bodies 32 serve as annular stop faces for the force reservoirs 4 and 5, associated with the inlet-side and outlet-side ends, respectively, of the control element 1. The force reservoirs 4, 5 can preferably be embodied as helical springs. To increase the prestressing force that can be generated at the control element 1, the helical springs can be embodied as spring packets, for instance connected parallel and nested one inside the other, or in series with one another. Instead of helical springs, other spring elements can be provided instead, such as a spring rings or cup springs, in the bore 31 of the housing 6 to act as the force reservoir 4, 5 that acts on the control element.

In the bore 31, annular stop faces 13 and 14 that limit the stroke travel of the control element 1 are embodied. The stops 13, 14 can be shrink-fitted in the bore 31, for instance in the form of annularly extending sleeve elements. The stops 13, 14 are placed in the bore 31 in such a way that by means of the cylindrical closing element 32 provided on the inlet side, the high-pressure line 7 is uncovered by the control edge 17 toward the housing, and the control edge 18 provided on the slide side on the cylindrical closing body 32, just at that time, while when the outlet-side closing cylinder 32 rests on the stop 13—as shown in FIG. 1—the pressureless outlet 8 is just then uncovered toward the reservoir 21, so that excess fuel or motor oil still present in the hollow chamber 28 can flow out.

In the housing 6 of FIG. 1, there is a high-pressure line 7, by way of which the housing 6 communicates with a high-pressure collection chamber 12. The high-pressure collection chamber 12 (common rail) is subjected to fuel from a reservoir 21, for instance, via a high-pressure pump 23; the current fuel level prevailing in the it reservoir 21 is indicated by reference numeral 22. The pressureless outlet line 8 extending from the housing 6 discharges directly into the reservoir 21 and carries excess fuel back into the reservoir 21.

In injection systems for internal combustion engines, the high-pressure collection chamber 12 is acted upon by fuel that is at extremely high pressure. In a high-pressure pump, which can also be acted upon via the 3/2-way valve, the high-pressure collection chamber 12 is filled not with fuel, for instance, but with mineral oil, such as motor oil. The two actuating devices 2, 3 can be connected to one another via tie rods 26 and 27, respectively, which can in turn be provided with securing nuts 29 in order to brace the two actuating devices 2, 3 against one another.

The mode of operation of the 3/2-way valve proposed according to the invention proceeds from the triggering of the actuating devices 2, 3, preferably electromagnets, via the control unit 15 via trigger lines 30. In the position of the control element 1 as shown in FIG. 1, the inlet-side actuating device 2, for instance, is triggered and repels the face opposite it of the control element 1, while the actuating device 3 positioned on the outlet side attracts the face opposite it of the control element 1. Reinforced by the relaxation of the inlet-side force reservoir 4, the high-pressure line 7 is closed by overlap of the control edge 17 on the housing side, and the control edge 18 on the slide side. In the control state of the control element 1 as shown in FIG. 1, a quantity of fuel or motor oil has reached the supply line 9, while after opening of the hollow chamber 28 by opening of the pressureless outlet 8, excess fuel or possibly excess motor oil, depending on the application, can flow back into the reservoir.

In an oppositely extending motion of the control element 1, triggering of the outlet-side actuating device 3 takes place, in such a way that the face opposite it of the control element 1 is repelled. The actuating device 2 on the inlet side can be triggered by the control unit 15 in such a way that it attracts the outlet-side face, opposite it, of the control element 1. As a result, the control element 1 moves toward the high-pressure line 7 and closes the outlet 8 by means of the overlapping control edge 20 on the housing side and the control edge 19 provided on the cylindrical closing body 32. In the process, the force reservoir 4 on the outlet side is compressed, until the closing cylinder 32 on the outlet side rests on the stop 14. The motion closing the outlet 8 is reinforced by the force reservoir 5 on the outlet side, which reinforces the closing m motion by means of its relaxation.

While the period of time that elapses from the closing motion of the high-pressure line 7 until the opening of the outlet 8, the supply line 9 is briefly subjected only to the fluid volume enclosed in the hollow chamber 28 and carries this volume, via a supply line 9, to the injection systems that communicate with the housing 6 of the 3/2-way valve.

The closing cylinders 32 are received coaxially to the e axis s 25 of the control element 1. Control edges that limit the quantities of fuel or motor oil to be dimensioned, depending on the injection system to be acted upon, can be made simply and economically on the face ends of the closing cylinders 32. In addition to accurate metering of the volume to be injected, the degree of overlap of the pairs of control edges 17, 18 and 19, 20 assures sealing that limits leakage losses to a minimum. Whatever quantity of fuel or motor oil is enclosed in the hollow chamber 28 can be specified precisely by specifying the diameter of the portions of the control element 1 that connect the closing cylinders 32 to one another.

Figure 1A:
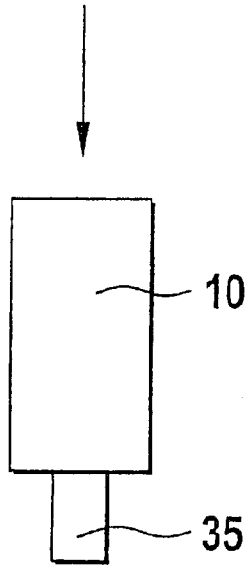
FIG. 1*a* schematically illustrates an injection nozzle that can be connected to the housing of the 3/2-way valve.
Figure 1B:
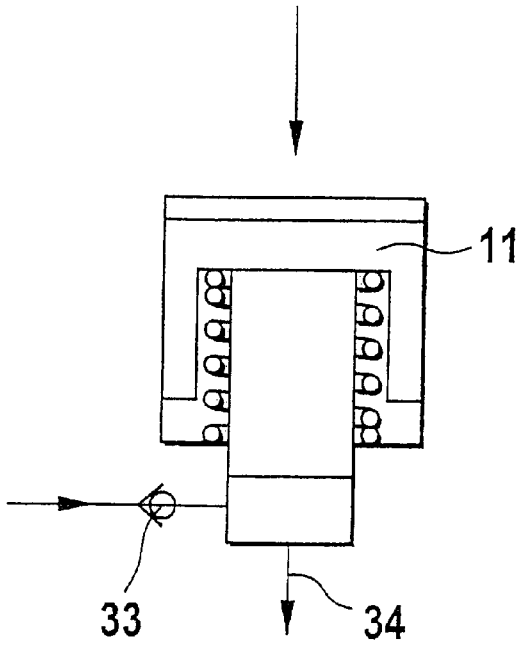
FIG. 1*b* schematically illustrates a hydraulically driven high-pressure pump.

FIG. 1*a* shows an injection nozzle 10 in a schematic arrangement in the form of an injection system connected to the connecting bore. The opening 35 of this nozzle—which can be uncovered by a nozzle needle closure—protrudes into the combustion chamber of an internal combustion engine. Alternatively, as an injection system, a high-pressure pump 11 shown schematically in FIG. 1*b* can be acted upon by motor oil, for instance, which subjects a line 34 to elevated pressure. The pressure chamber can be sealed off with a blocking valve 33 and can open once a certain, presettable overpressure is exceeded. In this application of the 3/2-way valve of the invention to act upon a high-pressure pump 11, the high-pressure collection chamber 12 is acted upon not with fuel but with motor oil—which is named here solely as an example—that is at high pressure.

The foregoing relates to preferred exemplary embodiment of the invention, it being understood that other variants ane embodiments thereof are possible within the spirit and scope of the invention, the latter being defined by the appended claims.

I claim:

1. In a control element for an injection system, which includes a high-pressure collection container (12), from which a high-pressure line (7) extends to a housing (6) surrounding the control element (1), and the housing (6) includes both a pressureless outlet (8) to a reservoir (21) and a connecting bore (9) leading to injection systems (34, 35), the improvement wherein the overlap of inlet-side control edges (17, 18), which brings about a closure of the high-pressure line (7), is effected by means of triggering actuating devices (2, 3) and by the relaxation of a force reservoir (14) on the control element (1).

2. The control element of claim 1, wherein the control element (1) receives closing bodies (32), on which control edges (18, 19) toward the control element are embodied.

3. The control element of claim 2, wherein the closing bodies (32) cooperate with control edges (17, 20) embodied on the housing (6).

4. The control element of claim 1, wherein said control element (1) is acted upon by at least one force reservoir (4, 5) braced on the housing (6).

5. The control element of claim 2, wherein the connecting bore (9) branches off toward the injection systems (34, 35) from a hollow chamber (28) located between the control edges (18, 19) of the control element (1).

6. The control element of claim 1, wherein the maximum opening of the high-pressure inlet (7) and pressureless outlet (8) is limited by stops (13, 14) provided for the control element (1) in the bore (31).

7. The control element of claim 1, wherein the actuating devices (2, 3) opposite the respective ends of the control element (1) are each triggerable independently of one another by a control unit (15).

8. The control element of claim 7, wherein the actuating devices (2, 3) are embodied as electromagnets.

9. The control element of claim 1, wherein the closure of the high-pressure inlet (7) and the opening of the pressureless outlet (8) by the control slide (1) after triggering of the actuating devices (2, 3) takes place counter to the action of the outlet-side force reservoir (5).

10. The control element of claim 1, wherein the closure of the outlet (8) and the opening of the high-pressure inlet (7) by the control element (1) after triggering of the actuating devices (2, 3) takes place counter to the action of the inlet-side force reservoir (4).

* * * * *